US007696944B2

(12) United States Patent
Noro et al.

(10) Patent No.: US 7,696,944 B2
(45) Date of Patent: Apr. 13, 2010

(54) ANTENNA APPARATUS

(75) Inventors: Junichi Noro, Akita (JP); Takao Kato, Oga (JP)

(73) Assignee: Mitsumi Electric Co., Ltd., Tama-Shi (JP)

( * ) Notice: Subject to any disclaimer, the term of this patent is extended or adjusted under 35 U.S.C. 154(b) by 312 days.

(21) Appl. No.: 11/881,084

(22) Filed: Jul. 25, 2007

(65) Prior Publication Data

US 2008/0055180 A1 Mar. 6, 2008

(30) Foreign Application Priority Data

Sep. 4, 2006 (JP) ..... 2006-239053

(51) Int. Cl.
*H01Q 1/52* (2006.01)

(52) U.S. Cl. ..... 343/841; 343/700 MS

(58) Field of Classification Search ..... 343/841, 343/700 MS, 702
See application file for complete search history.

(56) References Cited

U.S. PATENT DOCUMENTS 5,585,806 A * 12/1996 Ogino et al. ..... 343/700 MS
7,327,328 B2 * 2/2008 Yoneya et al. ..... 343/841
7,589,691 B2 * 9/2009 Noro ..... 343/841
2008/0068277 A1 * 3/2008 Iizuka et al. ..... 343/841
2008/0068278 A1 * 3/2008 Noro ..... 343/841

FOREIGN PATENT DOCUMENTS

JP 11-74671 A 3/1999
JP 2001-068175 A 3/2001
JP 2003-17154 A 1/2003
JP 2005-109688 A 4/2005

* cited by examiner

*Primary Examiner*—Tan Ho
(74) *Attorney, Agent, or Firm*—Frishauf, Holtz, Goodman & Chick, P.C.

(57) ABSTRACT

Disclosed is an antenna apparatus including: an antenna element including a receiving unit to receive an electric wave; a circuit substrate including a circuit surface on which a circuit amplifying an input from the antenna element is formed; a shield cover covering the circuit surface to shield the circuit substrate from a disturbing wave, the shield cover being grounded; a coaxial cable to supply driving power and GND potential to the circuit, and to output a signal from the circuit, the coaxial cable inserted into the shield cover, wherein the shield cover includes a base surface disposed in parallel with the circuit surface and a tongue flap extending to the coaxial cable, and the tongue flap includes a connecting piece formed by bending an end of the tongue flap at a side of the coaxial cable, the connecting piece being soldered to an outer conductor of the coaxial cable.

5 Claims, 5 Drawing Sheets

ANTENNA APPARATUS

BACKGROUND OF THE INVENTION

1. Field of the Invention

The present invention relates to an antenna apparatus, and more particularly to an antenna apparatus used for receiving electric waves of a global positioning system (GPS), a satellite radio, and the like.

2. Description of Related Art

For example, an antenna apparatus illustrated in FIG. 7 was developed as an antenna apparatus to be used for an in-car GPS system, which was spread as a positioning system, and an antenna apparatus to be used for in-car or a in-home fixed type satellite radio, which was put to practical use in US (see, for example, Japanese Patent Application Laid-Open Publications No. Hei 11-74671, No. 2001-68175, and No. 2005-109688).

In the example of the antenna apparatus 100, a circuit substrate 103 is stuck on the back of an antenna element 102 having a patch type receiving surface 101 receiving electric waves. A not shown circuit amplifying an input from the antenna element 102 is formed on the surface on the opposite side of the circuit substrate 103 to the antenna element 102, and the surface on which the circuit is formed is covered by a substantially box-like shield cover 104.

The shield cover 104 is made of a metal to shield the circuit from disturbing waves from the outside. Moreover, the base surface 104*a* of the substantially box-like shield cover 104 is disposed in parallel with the receiving surface 101 of the antenna element 102. Incidentally, the receiving surface 101 of the antenna element 102 is drawn to be thicker than the actual thickness thereof in FIG. 7.

A coaxial cable 105 is inserted into the shield cover 104. The core wire 105*a* of the coaxial cable 105 is connected to the circuit on the circuit substrate 103 by being soldered to the circuit. The coaxial cable 105 supplies driving power to the circuit, and outputs a signal that has been received by the antenna element 102 and amplified by the circuit.

Moreover, the shield cover 104 also functions as the ground (GND), and a tongue flap 104*b* is formed on the shield cover 104 to be bent from the base surface 104*a* of the shield cover 104 to the side of the coaxial cable 105. The tongue flap 104*b* is then connected to the outer conductor 105*b* of the coaxial cable 105 by being soldered to the outer conductor 105*b* with solder H, and thereby the shield cover 104 is set to the GND potential through the tongue flap 104*b*. The circuit substrate 103 is grounded through the shield cover 104.

Various structures were conventionally proposed as the structure of the tongue flap 104*b* of the shield cover 104. For example, Japanese Patent Application Laid-Open Publication No. Hei 11-74671 discloses the tongue flap 104*b* which is bent substantially perpendicularly to the base surface 104*a* of the shield cover 104 and the end of which is formed to an arcuate notch along the outer conductor 105*b* of the coaxial cable 105 on the side of the coaxial cable 105, as shown in FIG. 8.

Incidentally, FIG. 8 shows the circuit substrate 103, the shield cover 104 and the coaxial cable 105 in the case where the antenna apparatus 100 of FIG. 7 is turned upside down, and omits to show the soldering between the tongue flap 104*b* of the shield cover 104 and the outer conductor 105*b* of the coaxial cable 105.

Moreover, Japanese Patent Application Laid-Open Publication No. 2003-17154 discloses the tongue flap that is similarly bent from the base surface 104*a* of the shield cover 104 toward the coaxial cable 105 not substantially perpendicularly from the base surface 104*a* like the tongue flap 104*b* shown in FIG. 8, but is bent obliquely, although the tongue flap is not shown. Japanese Patent Application Laid-Open Publication No. 2003-17154 proposes to ground the shield cover by bringing the tongue flap into elastic contact with the outer conductor of the coaxial cable so that the tongue flap may press the outer conductor without soldering the tongue flap to the outer conductor.

However, the aforesaid tongue flap structure in the antenna apparatus described in Japanese Patent Application Laid-Open Publication No. 2003-17154 has the possibility that the strength of the elastic contact of the tongue flap to the outer conductor of the coaxial cable lowers with time to produce a contact failure owing to the influences of the vibrations of a car, and the like, for example, the antenna apparatus is for in-car use. Moreover, because the connection portion between the tubular outer conductor of the coaxial cable and the tabular tongue flap is in the state of point contact, the efficiency of the grounding of the shield cover lowers.

In this respect, in the antenna apparatus described in Japanese Patent Application Laid-Open Publication No. Hei 11-74671, because the connection portion between the tongue flap 104*b* and the outer conductor 105*b* of the coaxial cable 105 is soldered, no bad connection is caused. Moreover, because the connection area between the tongue flap 104*b* and the outer conductor 105*b* in the connection portion can be enlarged, the grounding efficiency of the shield cover 104 through the tongue flap 104*b* can be sufficiently secured.

However, as to the tongue flaps 104*b* shown in FIGS. 7 and 8, the solder H in the connection portions sometimes rises higher than the heights of the base surfaces 104*a* of the shield covers 104 at the time of the soldering of the tongue flaps 104*b* to the outer conductors 105*b* of the coaxial cables 105. If the antenna apparatus 100 in which the solder H rises like this is, for example, placed on a horizontal surface with a bottom cover 106 put between them, as shown in FIG. 9, then the receiving surface 101 of the antenna element 102 inclines to the horizontal surface shown by an alternate long and short dash line in FIG. 9. Consequently, the directivity of the antenna becomes worse, and the reception efficiency of electric waves lowers. Moreover, the assembly accuracy of the antenna apparatus 100 also lowers.

Moreover, in the aforesaid antenna apparatus for the GPS system, the satellite radio, and the like, which antenna apparatus receives a high frequency signal and amplifies the received signal, the improvement of the grounding efficiency of the circuit substrate is regarded as a vital problem. The improvement of the grounding efficiency is frequently achieved by making the bottom cover 106 of a metal, and by bringing the bottom cover 106 and the base surface 104*a* of the shield cover 104 into surface contact.

If the solder H rises higher than the height of the base surface 104*a* of the shield cover 104 at the connection portion of the tongue flap 104*b* with the outer conductor 105*b* of the coaxial cable 105 in the antenna apparatus like this, then the base surface 104*a* of the shield cover 104 rises from the bottom cover 106 as shown in FIG. 9, and the bottom cover 106 and the shield cover 104 cannot be brought into the surface contact. Consequently, it becomes impossible to improve the grounding efficiency.

If the solder rises in a connection portion, various problems are caused as described above. Accordingly, it is needed to prevent the solder from rising at the time of manufacturing antenna apparatus. However, if the soldering of connection portions is carefully performed one by one, the manufacturing efficiency of the antenna apparatus lowers. Consequently, the soldering structure is required that can perform soldering without raising the solder in a connection portion or without raising the solder not to be higher than the height of the base surface 104*a* of the shield cover 104 even if the solder rises by performing an ordinary soldering operation.

SUMMARY

The present invention was made under the situation like this, and aims to provide an antenna apparatus having a soldering structure capable of preventing solder from rising higher than the height of the base surface of a shield cover in a connection portion between the tongue flap of the shield cover and the outer conductor of a coaxial cable by performing an ordinary soldering operation.

According to a first aspect of the present invention, an antenna apparatus comprises: an antenna element which includes a receiving unit to receive an electric wave; a circuit substrate including a circuit surface on which a circuit is formed, the circuit amplifying an input from the antenna element; a shield cover covering the circuit surface to shield the circuit substrate from a disturbing wave, the shield cover being grounded; a coaxial cable to supply driving power and GND potential to the circuit on the circuit substrate, and to output a signal from the circuit, the coaxial cable being inserted into the shield cover, wherein the shield cover includes a base surface disposed in parallel with the circuit surface, and a tongue flap extending from the base surface to the coaxial cable, and the tongue flap includes a connecting piece which is formed by bending an end of the tongue flap at a side of the coaxial cable, the connecting piece being soldered to an outer conductor of the coaxial cable.

BRIEF DESCRIPTION OF THE DRAWINGS

The present invention will become more fully understood from the detailed description given hereinbelow and the appended drawings which given by way of illustration only, and thus are not intended as a definition of the limits of the present invention, and wherein.

DETAILED DESCRIPTION OF THE PREFERRED EMBODIMENTS

In the following, the preferred embodiment of an antenna apparatus according to the present invention will be described with reference to the attached drawings.

Figure 1:
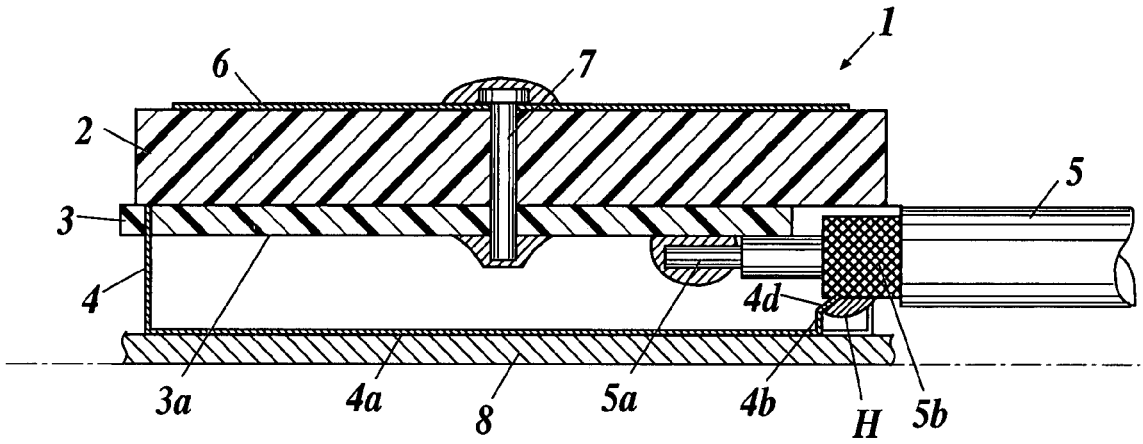
FIG. 1 is a schematic sectional view showing the configuration of an antenna apparatus according to the present embodiment.
Figure 2:
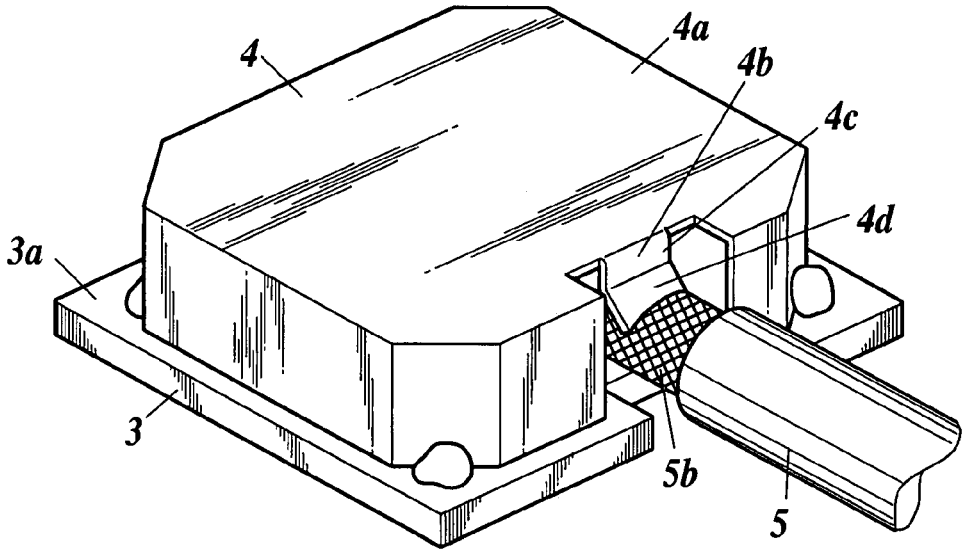
FIG. 2 is a perspective view showing a shield cover, a coaxial cable, and the like, in the state in which the antenna apparatus shown in FIG. 1 is turned upside down.

An antenna apparatus 1 according to the present embodiment includes an antenna element 2, a circuit substrate 3, a shield cover 4, a coaxial cable 5, and the like, as shown in FIGS. 1 and 2. Incidentally, FIG. 2 and FIGS. 3-6, which will be described later, show the state of the shield cover 4, the coaxial cable 5, and the like, in which the antenna apparatus 1 shown in FIG. 1 is turned upside down. Moreover, the showing of the soldering of a tongue flap 4*b* of the shield cover 4 to an outer conductor 5*b* of the coaxial cable 5, which will be described later, is omitted.

The antenna element 2 is made of a ceramic to be formed in a plate being slightly thick in the present embodiment. A patch type receiving surface 6 as a receiving unit receiving electric waves is stuck on a surface of the antenna element 2 on one side. Incidentally, the receiving surface 6 of the antenna element 2 is drawn to be thicker than the actual thickness thereof in FIG. 1. Moreover, a not shown GND pattern shaped in a metallic thin film is stuck on almost the whole surface of the antenna element 2 on the opposite side to the receiving surface 6 except for an input pin 7 and the circumjacent part thereof.

The circuit substrate 3 is provided on the opposite surface side of the antenna element 2 to the receiving surface 6. A not shown GND pattern shaped in a metallic thin film is stuck on almost the whole surface of the circuit substrate 3 on the side of the antenna element 2 except for the input pin 7 and the circumjacent part thereof separately from the GND pattern of the antenna element 2.

In the present embodiment, the GND pattern of the circuit substrate 3 and the GND pattern of the antenna element 2 are stuck together with an adhesive member, such as a double-coated adhesive tape, and the antenna element 2 and the circuit substrate 3 are thereby bonded together. Moreover, the GND pattern of the circuit substrate 3 functions as the GND pattern of the antenna element 2 together with the GND pattern of the antenna element 2 itself.

A not shown circuit amplifying an input from the antenna element 2 to output the amplified input is formed on the surface of the circuit substrate 3 on the opposite side to the antenna element 2, i.e., a circuit surface 3*a*. A not shown plurality of through-holes is formed in the circuit substrate 3 at suitable positions, and the GND of the circuit on the circuit surface 3*a* is connected to the GND pattern on the back surface of the circuit substrate 3 through the through-holes.

The input pin 7 penetrates through the receiving surface 6 of the antenna element 2 and the circuit surface 3*a* of the circuit substrate 3 perpendicularly to them at a predetermined position of the antenna element 2 and the circuit substrate 3. In the present embodiment, the input pin 7 is electrically connected to the receiving surface 6 and the circuit by soldering, and the input pin 7 inputs an electric wave signal received by the receiving surface 6 of the antenna element 2 to the circuit of the circuit substrate 3.

The shield cover 4, which is made of a metal and formed in substantially a box, is attached to the circuit substrate 3 on the side of the circuit surface 3*a* so as to cover the circuit surface 3*a*, and the shield cover 4 shields the circuit surface 3*a* from disturbing waves arriving at the circuit surface 3*a* from the outside. Moreover, a base surface 4*a* of the substantially box-like shield cover 4 is arranged in parallel to the receiving surface 6 of the antenna element 2 and the circuit surface 3*a* of the circuit substrate 3.

As shown in the sectional view of FIG. 1, a part of the shield cover 4 is formed as a projection to penetrate the circuit substrate 3, and thereby the shield cover 4 is located to the circuit substrate 3. Moreover, as shown in FIG. 2, in the present embodiment, the shield cover 4 is electrically connected to the GND of the circuit by being soldered to the GND on the circuit surface 3*a* of the circuit substrate 3.

In the inside of the shield cover 4, the coaxial cable 5 is inserted. The core wire 5*a* of the coaxial cable 5 is electrically connected to the circuit on the circuit surface 3*a* of the circuit substrate 3 by soldering. Driving power is supplied to the circuit through the core wire 5*a*, and a signal received with the antenna element 2 and amplified by the circuit is output from the circuit through the core wire 5*a*.

Moreover, the tongue flap 4*b* is formed on the shield cover 4 so as to be bent from the base surface 4*a* of the shield cover 4 to extend to the coaxial cable 5.

In the present embodiment, the tongue flap 4*b* is bent at a position between the bent portion from the base surface 4*a* of the shield cover 4 and the end on the coaxial cable side, and the tongue flap 4*b* includes a tabular base 4*c* formed by being bent from the base surface 4*a* of the shield cover 4 toward the coaxial cable 5 at almost a right angle and a tabular connecting piece 4*d* formed by the bending of the end of the tongue flap 4*b* on the coaxial cable side.

In the terminal portion of the connecting piece 4*d*, an arcuate notch along the outer conductor 5*b* of the coaxial cable 5 is formed, and the connecting piece 4*d* and the outer conductor 5*b* of the coaxial cable 5 are electrically connected to each other by soldering in the state in which the notch portion comes close to or abuts on the outer conductor 5*b*.

Figure 3:
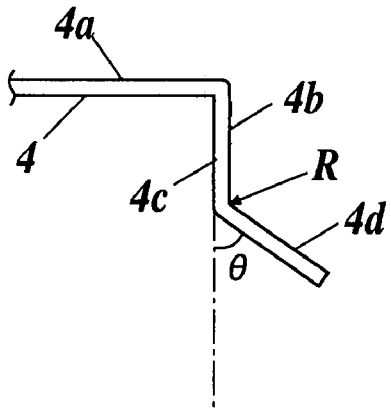
FIG. 3 is a schematic view illustrating an angle between the base of the tongue flap of the shield cover and a connecting piece.

In the present embodiment, if the angle formed by the base 4*c* of the tongue flap 4*b* and the connecting piece 4*d* is denoted by θ as shown in FIG. 3, then the connecting piece 4*d* is bent at a bent portion R to the base 4*c* toward the outside of the shield cover 4 so that the angle θ may within the range:

$$0° < \theta \leqq 90° \quad (1).$$

Figure 4:
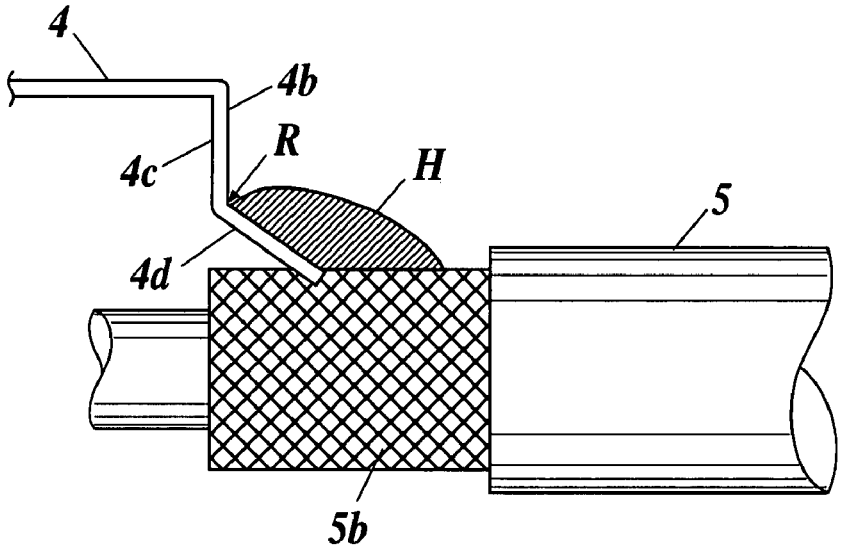
FIG. 4 is an enlarged view showing a soldering structure of the tongue flap of the shield cover and the outer conductor of the coaxial cable according to the present embodiment.

Moreover, in the present embodiment, as shown in FIG. 4, the surface on the opposite side to the surface opposed to the coaxial cable 5 between the front/back surfaces of the tabular connecting piece 4*d* and the outer conductor 5*a* of the coaxial cable 5 are electrically connected to each other by the soldering using the solder H.

Figure 5:
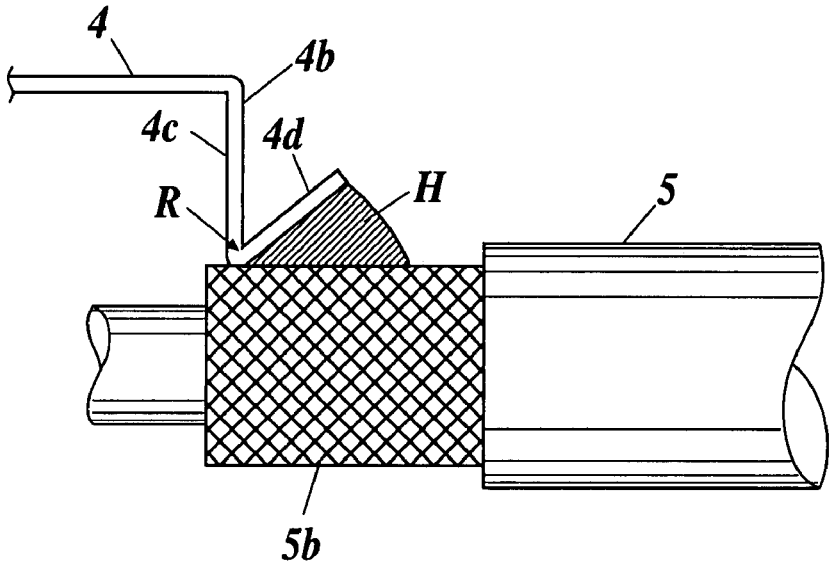
FIG. 5 is an enlarged view showing a modification of the soldering structure of the tongue flap to the outer conductor.
Figure 6:
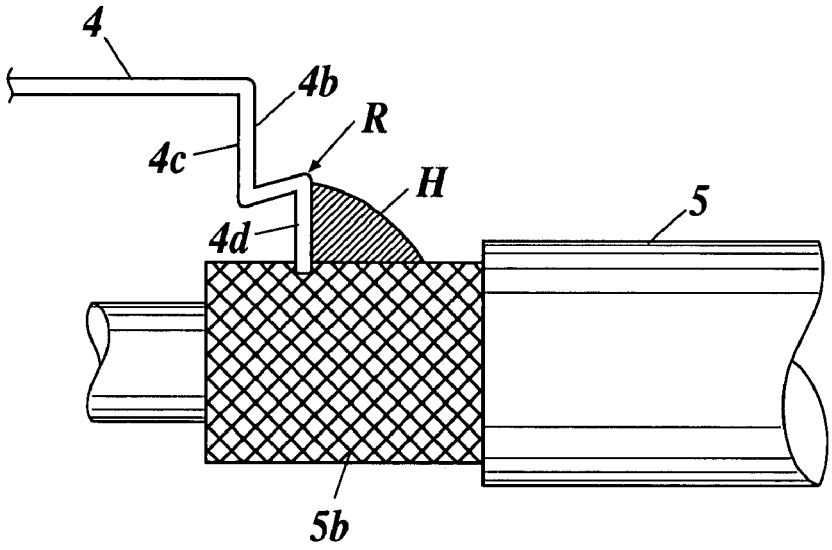
FIG. 6 is an enlarged view showing another modification of the soldering structure of the tongue flap to the outer conductor.
Figure 7:
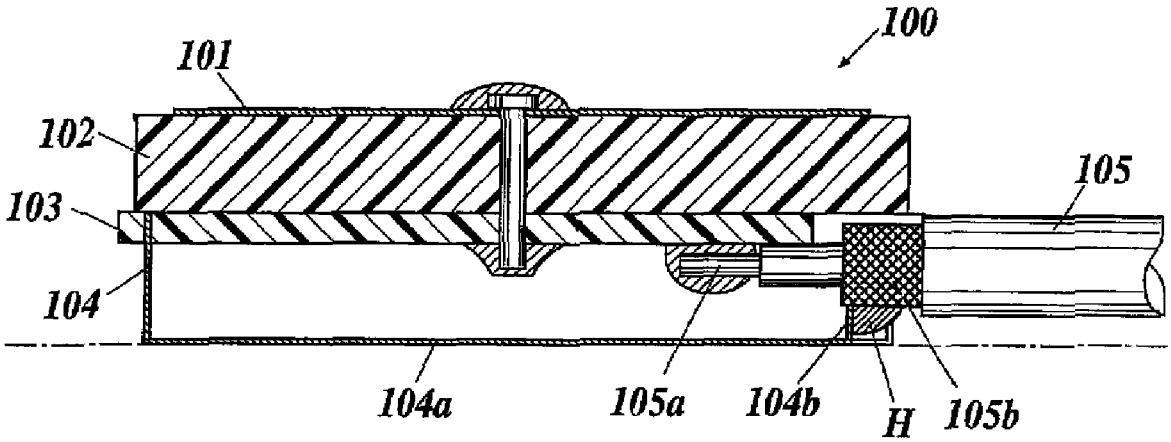
FIG.7 PRIOR ART
FIG. 7 is a schematic sectional view showing the configuration of a conventional antenna apparatus.
Figure 8:
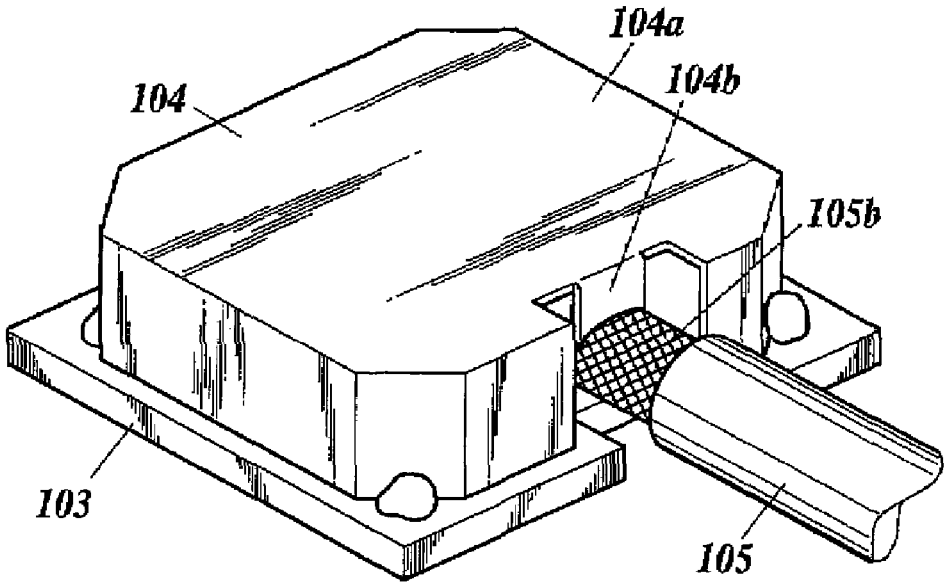
FIG.8 PRIOR ART
FIG. 8 is a perspective view showing a shield cover, a coaxial cable, and the like, in the state in which the antenna apparatus shown in FIG. 7 is turned upside down.

Incidentally, although the state in which the connecting piece 4*d* of the tongue flap 4*b* is soldered only to a part of the outer conductor 5*b* is schematically shown in FIG. 4 and FIGS. 5 and 6, both will be described later, the tongue flap 4*b* and the outer conductor 5*b* of the coaxial cable 5 are actually soldered together by infiltrating the solder H into almost the whole area in the circumferential direction of the outer conductor 5*b*.

The GND potential is supplied to the outer conductor 5*b* of the coaxial cable 5, and the GND potential is supplied from the outer conductor 5*b* of the coaxial cable 5 to the circuit of the circuit substrate 3 through the tongue flap 4*b* and the shield cover 4 by the connection of them by the soldering.

Moreover, in the present embodiment, as shown in FIG. 1, the antenna apparatus 1 is provided with a bottom cover 8 made of a metal on the outside of the base surface 4*a* of the shield cover 4, and the further improvement of the grounding efficiency of the circuit is achieved by bringing the base surface 4*a* of the shield cover 4 and the bottom cover 8 into surface contact.

Next, the operation of the antenna apparatus 1 according to the present embodiment will be described.

Driving power is supplied to the circuit on the circuit substrate 3 of the antenna apparatus 1 through the core wire 5*a* of the coaxial cable 5. When the receiving surface 6 of the antenna element 2 receives a high frequency electric wave for the GPS or for a satellite radio, the electric wave signal is transmitted to the circuit on the circuit substrate 3 through the input pin 7, and an electric wave signal amplified by the circuit is output through the core wire 5*a* of the coaxial cable 5.

The circuit of the circuit substrate 3 is shielded from disturbing waves from the outside by the shield cover 4 made of a metal, which cover 4 covers the circuit. Moreover, the GND of the circuit is connected to the shield cover 4, as described above, and the circuit is grounded by receiving the supply of the GND potential from the outer conductor 5*b* of the coaxial cable 5 to the shield cover 4. The GND potential is also supplied to the GND pattern of the circuit substrate 3 through the through-holes of the circuit substrate 3, and the GND pattern of the circuit substrate 3 is grounded, so that the GND level is provided to the antenna element 2.

At that time, the surface on the opposite side to the surface opposed to the coaxial cable 5 between surfaces of the tabular connecting piece 4*d* formed at the end on the coaxial cable side of the tongue flap 4*b* of the shield cover 4 and the outer conductor 5*a* of the coaxial cable 5 are soldered together, and the tongue flap 4*b* and the outer conductor 5*b* of the coaxial cable 5 are connected to each other by being soldered together so as to infiltrate the solder H over almost the whole area in the circumferential direction of the outer conductor 5*b*. In this way, the contact area of the tongue flap 4*b* and the outer conductor 5*b* is more enlarged, and thereby the grounding efficiency of the shield cover 4 through the tongue flap 4*b* is improved.

Moreover, in the soldering, the melted solder H infiltrates the outer conductor 5*a* and diffuses onto the connecting piece 4*d* by the surface tension of the melted solder H. Because the connecting piece 4*d* (bent portion) is formed by being bent to the base 4*c* of the tongue flap 4*b*, the surface tension of the melted solder H is intercepted at the bent portion R between the base 4*c* of the tongue flap 4*b* and the connecting piece 4*d*. Consequently, the spreading of the melted solder H into the direction of the base 4*c* of the tongue flap 4*b* is effectively obstructed, and it is prevented that the melted solder H spreads on the surface of the base 4*c* to rise higher than the height of the base surface 4*a* of the shield cover 4.

In this case, even if ordinary soldering operation is performed at the time of soldering, the diffusion of the melted solder H on the connecting piece 4*d* (bent portion) surely stops at the bent portion R. Consequently, it is unnecessary to perform the soldering especially carefully or to perform the soldering using an especial technique, and the diffusion of the melted solder H onto the base 4*c* of the tongue flap 4*b* can be sufficiently obstructed by the ordinary soldering operation to surely prevent the rise of the solder H.

Incidentally, by providing the bottom cover 8 made of a metal to the bottom of the antenna apparatus 1, and by bringing the base surface 4*a* of the shield cover 4 and the bottom cover 8 into surface contact to ground the shield cover 4 like the present embodiment, the grounding efficiency of the circuit is more improved.

As described above, by the antenna apparatus 1 according to the present embodiment, the end of the tongue flap 4*b* of the shield cover 4 on the coaxial cable side is bent to form the connecting piece 4*d*, and the connecting piece 4*d* and the outer conductor 5*b* of the coaxial cable 5 are soldered together. Consequently, the surface tension of the melted solder H is intercepted at the bent portion R between the connecting piece 4*d* and the base 4*c* of the tongue flap 4*b*, and the diffusion of the melted solder H to the side of the base 4*c* is obstructed.

Hence, even if the ordinary soldering operation is performed, it is surely prevented that the solder H spreads on the surface of the base 4*c* of the tongue flap 4*b* to rise higher than the base surface 4*a* of the shield cover 4, and it becomes possible to surely connect shield cover 4 with the coaxial cable 5 through the tongue flap 4*b* by suitably soldering the connecting piece 4*d* to the outer conductor 5*b*.

Figure 9:
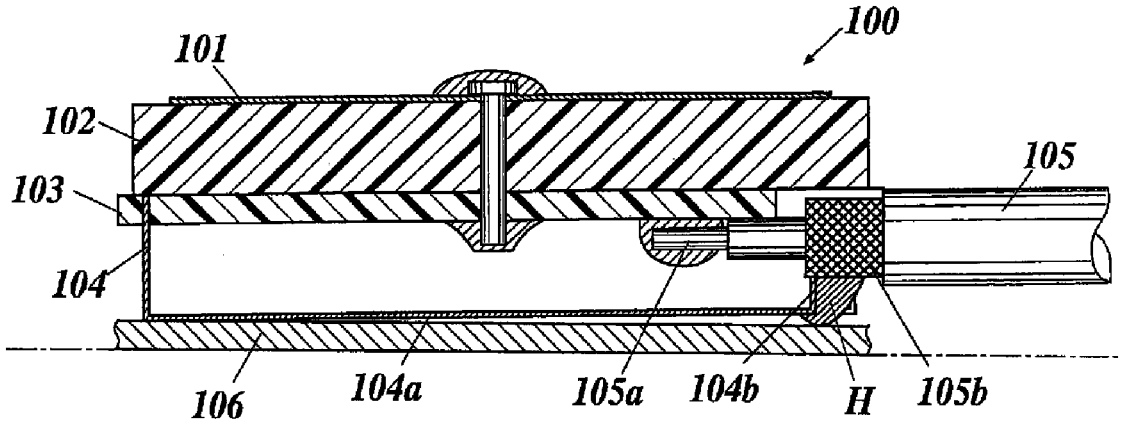
FIG.9 PRIOR ART
FIG. 9 is a schematic sectional view for illustrating a rise of the shield cover owing to a rise of solder.

Moreover, because the rise of the solder H in the connection portion between the tongue flap 4*b* and the outer conductor 5*b* of the coaxial cable 5 is not produced, it becomes possible to avoid the inclination of the shield cover owing to the rise from the bottom cover as shown in FIG. 9, and the normal directivity of the antenna can be obtained. The reception efficiency of electric waves is then stabilized, and it becomes possible to keep the assembly accuracy of the antenna apparatus 1.

Moreover, if grounding is performed by the surface contact between the base surface 4*a* of the shield cover 4 and the bottom cover 8 like the present embodiment, the grounding efficiency can be kept at a very high state. Moreover, because the soldering structure described above can be obtained by the ordinary soldering operation, the aforesaid advantages can be obtained without lowering the manufacturing efficiency of the antenna apparatus 1.

On the other hand, as described above, it is sufficient to bend the tongue flap 4*b* of the shield cover 4 only at one position between the bent portion from the base surface 4*a* of the shield cover 4 and the end of the tongue flap 4*b* on the coaxial cable side, and consequently the manufacturing process of the antenna apparatus 1 is not made to be complicated. Consequently, even if the tongue flap 4*b* is bent, the manufacturing efficiency of the antenna apparatus 1 is kept.

Moreover, if soldering is performed on the surface of the tabular connecting piece 4*d* on the opposite side to the surface thereof opposed to the coaxial cable 5 as shown in FIG. 4, the soldering can be performed from the upper side of the sheet of the drawing, and the soldering can be very easily performed.

Incidentally, the method of bending the connecting piece 4*d* of the tongue flap 4*b* and the surface on which the soldering of the connecting piece 4*d* is performed are not limited to those in the present embodiment.

For example, as shown in FIG. 5, it is also possible to connect the shield cover 4 with the coaxial cable 5 by greatly bending the connecting piece 4*d* to the base 4*c* of the tongue flap 4*b* toward the outside of the shield cover 4 so that the aforesaid angle θ may be within a range:

$$90° < \theta \leqq 180° \quad (2),$$

and by soldering the surface opposed to the coaxial cable 5 between the front/back surfaces of the tabular connecting piece 4*d* to the outer conductor 5*a* of the coaxial cable 5.

If the soldering is performed like this, it becomes possible to suitably solder the connecting piece 4*d* to the outer conductor 5*b* to surely connect the shield cover 4 with the coaxial cable 5 through the tongue flap 4*b*, and similar advantages to those of the embodiment mentioned above can be obtained. Furthermore, the surface tension of the melted solder H is surely intercepted in the bent portion R between the connecting piece 4*d* and the base 4*c* of the tongue flap 4*b* to obstruct the spreading of the melted solder H to the side of the base 4*c*. Consequently, it becomes possible to surely prevent the solder H from rising higher than the height of the base surface 4*a* of the shield cover 4 by the connecting piece 4*d* (bent portion).

Moreover, for example, as shown in FIG. 6, it is also possible to solder the connecting piece 4*d*, the end of the tongue flap 4*b* on the coaxial cable side, to the outer conductor 5*b* of the coaxial cable 5 by forming the tongue flap 4*b* to be bent at a plurality of positions between the bent portion from the base surface 4*a* of the shield cover 4 and the end on the coaxial cable side.

If the soldering is performed like this, it becomes possible to surely connect the shield cover 4 with the coaxial cable 5 through the tongue flap 4*b* by suitably soldering the connecting piece 4*d* to the outer conductor 5*b*, and similar advantages to those of the embodiment mentioned above can be obtained. Furthermore, the surface tension of the melted solder H is surely intercepted at the bent portion R nearest to the side of the connecting piece 4*d* among the plurality of bent portions, and the spreading of the melted solder H to the side of the base 4*c* is obstructed. Consequently, it becomes possible to prevent the solder H from rising higher than the height of the base surface 4*a* of the shield cover 4.

Incidentally, although the description has been given to the antenna apparatus 1 including the patch type receiving surface 6 receiving the high frequency electric waves for the GPS or for a satellite radio on the surface of the antenna element 2 in the present embodiment and the aforesaid modifications, the antenna apparatus of the present invention is characterized by the structure of the tongue flap of the shield cover as described above, and the configuration of the antenna element is not limited to the one including the patch type receiving surface.

According to the embodiment of the present invention, an antenna apparatus comprises: an antenna element which includes a receiving unit to receive an electric wave; circuit substrate including a circuit surface on which a circuit is formed, the circuit amplifying an input from the antenna element; a shield cover covering the circuit surface to shield the circuit substrate from a disturbing wave, the shield cover being grounded; a coaxial cable to supply driving power and GND potential to the circuit on the circuit substrate, and to output a signal from the circuit, the coaxial cable being inserted into the shield cover, wherein the shield cover includes a base surface disposed in parallel with the circuit surface, and a tongue flap extending from the base surface to the coaxial cable, and the tongue flap includes a connecting piece which is formed by bending an end of the tongue flap at a side of the coaxial cable, the connecting piece being soldered to an outer conductor of the coaxial cable.

Thereby, the connecting piece is formed by bending the end of the tongue flap of the shield cover on the side of the coaxial cable, and the connecting piece and the outer conductor of the coaxial cable are soldered together. Consequently, the surface tension of melted solder is intercepted by a bent portion of the connecting piece. It is then prevented that the melted solder spreads along the tongue flap.

Consequently, even if the ordinary soldering operation is performed, it is surely prevented that the solder spreads on the surface of the tongue flap to rise higher than the height of the base surface of the shield cover, and it is also enabled that the connecting piece and the outer conductor are suitably soldered together to surely connect the shield cover with the coaxial cable through the tongue flap.

Moreover, because the rise of the solder in the connection portion between the tongue flap and the outer conductor of the coaxial cable does not appears, the inclination of the shield cover owing to the rise thereof from a bottom cover as shown in FIG. 9 can be avoided, and normal antenna directivity can be obtained. The reception efficiency of electric waves is then stabilized, and the assembly accuracy of the antenna apparatus can be kept.

Moreover, if grounding is performed by the surface contact of the base surface of the shield cover with the bottom cover, the grounding efficiency can be kept in a very high state. Moreover, because the soldering structure mentioned above can be obtained by the ordinary soldering operation, the above advantages can be obtained without lowering the manufacturing efficiency of the antenna apparatus.

It is preferable that the connecting piece is formed by bending the tongue flap at one position.

By doing so, in addition to the advantages of the first aspect mentioned above, it is sufficient to bend the tongue flap of the shield cover only at one position between the bent portion from the base surface of the shield cover and the end of the coaxial cable side, and the manufacturing processes of the antenna apparatus does not become complicated. Consequently, even if the tongue flap is bent, the manufacturing efficiency of the antenna apparatus can be kept.

It is preferable that the connecting piece is formed by bending the tongue flap at a plurality of positions.

By doing so, in addition to the advantages of the first aspect mentioned above, the surface tension of the melted solder is surely intercepted by a bent portion nearest to the connecting piece to prevent the melted solder from spreading along the tongue flap, and it can be surely prevented that the solder rises higher than the height of the base surface of the shield cover.

It is preferable that a surface on an opposite side to a surface opposed to the coaxial cable between front/back surfaces of the tabular connecting piece is soldered to the outer conductor of the coaxial cable.

By doing so, in addition to the advantages of each aspect mentioned above, the antenna apparatus is configured to solder the solder on the surface of the connecting piece on the opposite side to the surface of the connecting piece opposed to the coaxial cable. Thereby, it becomes possible to perform soldering easily and surely, and to keep productivity. Furthermore, the high grounding efficiency of the shield cover can be surely kept.

It is preferable that a surface opposed to the coaxial cable between front/back surfaces of the tabular connecting piece is soldered to the outer conductor of the coaxial cable.

By doing so, in addition to the advantages of each aspect mentioned above, it becomes possible to suitably solder the connecting piece and the outer conductor of the coaxial cable together to surely connect the shield cover with the coaxial cable through the tongue flap. Furthermore, the surface tension of the melted solder is surely intercepted at the bent portion of the connecting piece to surely prevent the melted solder from spreading along the tongue flap, and consequently it is surely prevented that the solder rises higher than the height of the base surface of the shield cover by the bent portion.

The entire disclosure of Japanese Patent Application No. 2006-239053 filed on Sep. 4, 2007, including description, claims, drawings and summary are incorporated herein by reference in its entirety.

Although various exemplary embodiments have been shown and described, the invention is not limited to the embodiments. Therefore, the scope of the invention is intended to be limited solely by the following claims.

What is claimed is:

1. An antenna apparatus comprising:

an antenna element which includes a receiving unit to receive an electric wave;

a circuit substrate including a circuit surface on which a circuit is formed, the circuit amplifying an input from the antenna element;

a shield cover covering the circuit surface to shield the circuit substrate from a disturbing wave, the shield cover being grounded;

a coaxial cable to supply driving power and GND potential to the circuit on the circuit substrate, and to output a signal from the circuit, the coaxial cable being inserted into the shield cover, wherein the shield cover includes a base surface disposed in parallel with the circuit surface, and a tongue flap extending from the base surface to the coaxial cable, and the tongue flap includes a connecting piece which is formed by bending an end of the tongue flap at a side of the coaxial cable, the connecting piece being soldered to an outer conductor of the coaxial cable.

2. The antenna apparatus according to claim 1, wherein the connecting piece is formed by bending the tongue flap at one position.

3. The antenna apparatus according to claim 1, wherein the connecting piece is formed by bending the tongue flap at a plurality of positions.

4. The antenna apparatus according to claim 1, wherein a surface on an opposite side to a surface opposed to the coaxial cable between front/back surfaces of the tabular connecting piece is soldered to the outer conductor of the coaxial cable.

5. The antenna apparatus according to claim 1, wherein a surface opposed to the coaxial cable between front/back surfaces of the tabular connecting piece is soldered to the outer conductor of the coaxial cable.

* * * * *